US009038298B2

(12) United States Patent
Bacik

(10) Patent No.: US 9,038,298 B2
(45) Date of Patent: May 26, 2015

(54) SAFETY SIGN SYSTEM

(71) Applicant: John Andrew Bacik, Scottsdale, AZ (US)

(72) Inventor: John Andrew Bacik, Scottsdale, AZ (US)

( * ) Notice: Subject to any disclaimer, the term of this patent is extended or adjusted under 35 U.S.C. 154(b) by 47 days.

(21) Appl. No.: 13/829,693

(22) Filed: Mar. 14, 2013

(65) Prior Publication Data

US 2013/0247435 A1 Sep. 26, 2013

Related U.S. Application Data

(60) Provisional application No. 61/685,705, filed on Mar. 22, 2012.

(51) Int. Cl.

| | |
|---|---|
| ***G09F 23/00*** | (2006.01) |
| ***A45B 11/00*** | (2006.01) |
| ***A47C 4/00*** | (2006.01) |
| ***A47C 7/66*** | (2006.01) |
| ***E04H 12/22*** | (2006.01) |
| *A45B 25/18* | (2006.01) |

(52) U.S. Cl.

CPC ..... *G09F 23/00* (2013.01); *A45B 11/00* (2013.01); *A47C 4/00* (2013.01); *A47C 7/66* (2013.01); *E04H 12/22* (2013.01); *A45B 25/18* (2013.01); *A45B 2200/1009* (2013.01); *A45B 2200/1018* (2013.01); *A45B 2200/1054* (2013.01)

(58) Field of Classification Search

CPC ..... E04H 15/46; G09F 23/00; G09F 7/02
USPC ..... 135/25.1, 99
See application file for complete search history.

(56) References Cited

U.S. PATENT DOCUMENTS

| | | | | |
|---|---|---|---|---|
| 3,374,798 | A * | 3/1968 | Samuelson | 135/33.7 |
| 3,921,655 | A * | 11/1975 | Weber | 135/25.1 |
| 5,293,889 | A * | 3/1994 | Hall et al. | 135/16 |
| 5,333,824 | A * | 8/1994 | Dubinsky | 248/159 |
| 5,593,239 | A * | 1/1997 | Sallee | 403/109.3 |
| 5,634,482 | A * | 6/1997 | Martin | 135/16 |
| 6,073,642 | A * | 6/2000 | Huang | 135/114 |
| 6,199,569 | B1 * | 3/2001 | Gibson | 135/16 |
| 6,866,053 | B2 * | 3/2005 | You | 135/25.1 |
| 7,155,850 | B2 * | 1/2007 | Wilinsky et al. | 40/606.08 |
| 7,168,437 | B2 * | 1/2007 | Bigford | 135/16 |
| 7,290,742 | B2 * | 11/2007 | Wang | 248/200.1 |
| 7,311,110 | B2 * | 12/2007 | Wu | 135/24 |
| 7,318,444 | B2 * | 1/2008 | Clarke | 135/29 |
| 7,322,371 | B2 * | 1/2008 | You | 135/25.4 |
| 7,334,593 | B2 * | 2/2008 | Avery | 135/88.08 |

(Continued)

*Primary Examiner* — Shin Kim
(74) *Attorney, Agent, or Firm* — Whitley Legal Group, PC; AnnMarie W. Whitley

(57) ABSTRACT

A safety sign system comprises one or more traffic or informational signs, an expandable pole, a detachable umbrella canopy assembly, and a safety finial assembly. The signs are removably attached to a sleeve that surrounds a portion of a pole and rests upon a sign support. The sleeve with the signs attached swivels about the pole. The umbrella canopy assembly is attached to an upper end of the pole and may include additional features including reflective tape, vents, drop-down flaps, reflective coating, and lights. The safety finial assembly is removably attached to the top of the umbrella canopy assembly and may include flag supports, removable flags, and a safety light assembly. The safety sign system optionally further comprises a collapsible seat, a beverage holder, a satellite tracking device, a communication device, a base, and a control panel for operating the safety light and other features.

11 Claims, 12 Drawing Sheets

(56) References Cited

U.S. PATENT DOCUMENTS

| | | | | |
|---|---|---|---|---|
| 7,395,830 | B2 * | 7/2008 | Seo | 135/140 |
| 7,431,259 | B2 * | 10/2008 | Tung | 248/521 |
| 7,484,517 | B2 * | 2/2009 | Chen et al. | 135/25.4 |
| 7,614,600 | B1 * | 11/2009 | Smith et al. | 248/519 |
| 7,780,139 | B2 * | 8/2010 | Markert | 248/523 |
| 7,806,131 | B1 * | 10/2010 | Seiler | 135/33.2 |
| 8,322,666 | B2 * | 12/2012 | Duemmel | 248/166 |
| 8,365,747 | B1 * | 2/2013 | Su | 135/24 |
| 2002/0092550 | A1 * | 7/2002 | Chang | 135/20.3 |
| 2002/0104242 | A1 | 8/2002 | Haugen | |
| 2002/0175262 | A1 * | 11/2002 | Brooks, III | 248/530 |
| 2003/0079766 | A1 * | 5/2003 | Arrowood et al. | 135/16 |
| 2003/0234032 | A1 * | 12/2003 | Booth | 135/16 |
| 2004/0206382 | A1 * | 10/2004 | Clarke | 135/28 |
| 2005/0189005 | A1 * | 9/2005 | Smith et al. | 135/16 |
| 2006/0000131 | A1 * | 1/2006 | Wilinsky et al. | 40/606.08 |
| 2006/0081276 | A1 * | 4/2006 | Tung | 135/16 |
| 2009/0188537 | A1 | 7/2009 | Bacik | |
| 2011/0290289 | A1 * | 12/2011 | Ma | 135/25.1 |
| 2012/0145207 | A1 * | 6/2012 | VanVonderen | 135/98 |
| 2013/0087177 | A1 * | 4/2013 | Muinde | 135/25.4 |
| 2013/0092207 | A1 * | 4/2013 | Lovley et al. | 135/122 |
| 2013/0247435 | A1 * | 9/2013 | Bacik | 40/606.03 |

* cited by examiner

SAFETY SIGN SYSTEM

CROSS-REFERENCE TO RELATED APPLICATIONS

This application claims the benefit of U.S. Provisional Application 61/685,705 filed Mar. 22, 2012.

FIELD OF THE INVENTION

The present invention relates to an apparatus for controlling traffic. In particular, the present invention relates to a traffic sign system with a convertible umbrella and additional safety and comfort features that provides protection for the sign operator.

BACKGROUND OF THE INVENTION

A flagger is a person who directs vehicle or pedestrian traffic in a temporary road construction zone. Flaggers are particularly useful, for example, at road construction zones where construction necessitates that traffic come to a halt for an unspecified period of time. Typically, the flagger holds an upright pole that has a double sided sign where one side of the sign directs traffic to stop, and the other side of the sign directs traffic to proceed slowly. In addition to construction zones, flaggers can be found directing vehicle or pedestrian traffic in school zones, at sporting events, and at other large events where traffic needs to be directed or controlled.

Unfortunately, because flaggers must stand out in areas of vehicle or pedestrian traffic for long periods of time while directing traffic, they are exposed to uncomfortable or potentially harmful environmental elements. For example, a flagger may be working in direct sunlight for several hours a day and several days a week. Conversely, a flagger may be directing traffic while it is raining, hailing, snowing, or thunder storming. Because the flagger is exposed for significant amounts of time, he is at a higher risk for health problems such as heat stroke, heat exhaustion, dehydration, or cancer.

In addition to environmental elements, flaggers are also at risk of being injured by the traffic they are directing or of being ignored or unnoticed. Often a flagger's sign includes brightly colored flags to increase the visibility of the flagger to oncoming traffic. The flags both protect the flagger from harm and ensure that the oncoming traffic notices the change in traffic pattern. Unfortunately, some drivers fail to see the flags or flagger, and accidents occur.

For the above reasons, it would be desirable to provide an apparatus that allows a flagger to easily direct traffic while being protected from the sun and rain. It would be further desirable to provide an apparatus that can protect a flagger from sun and rain and increase the flagger's visibility. Additionally, it would be desirable to provide an apparatus that increases the flagger's comfort. Finally, it would be desirable to provide an apparatus that allows a flagger to modify its features to accommodate changes in either they environment or the traffic situation.

SUMMARY OF THE INVENTION

The safety sign system comprises one or more traffic or informational signs, an expandable pole, a detachable umbrella canopy assembly, and a removable safety finial assembly. The signs are removably attached to a removable sleeve that surrounds a portion of a pole and rests upon a sign support. The sleeve with the signs attached swivels about the pole. The umbrella canopy assembly is attached at an upper end of the pole and may include additional features including reflective tape, vents, drop-down flaps, reflective coating, and lights. The safety finial assembly is removably attached to the top of the umbrella canopy assembly and may include flag supports, removable flags, and a safety light assembly. The safety sign system optionally further comprises a collapsible seat, a beverage holder, a satellite tracking device, a communication device, a base, and a control panel for operating the safety light and other features.

For use in rainy or sunny conditions, the safety sign system is preferably used with the canopy attached and open. The drop-down flaps can be lowered to further protect the traffic controller from the sun or rain. Flags are secured in the finial, and preferably the safety light is operational. Two traffic signs are preferably attached to the sign sleeve so that oncoming traffic can either read the first sign or the second sign. The traffic controller can swivel the sleeve to display either the first sign or the second sign to the oncoming traffic. Additionally, the traffic controller can optionally control the safety light to further communicate the desired traffic signal. If the weather becomes windy and the canopy no longer is desired, the canopy can be removed, and the pole can be expanded to support the sleeve and signs. If desired, the finial also can be detached from the canopy and attached directly to the pole.

DETAILED DESCRIPTION OF PREFERRED EMBODIMENTS

Figure 1:
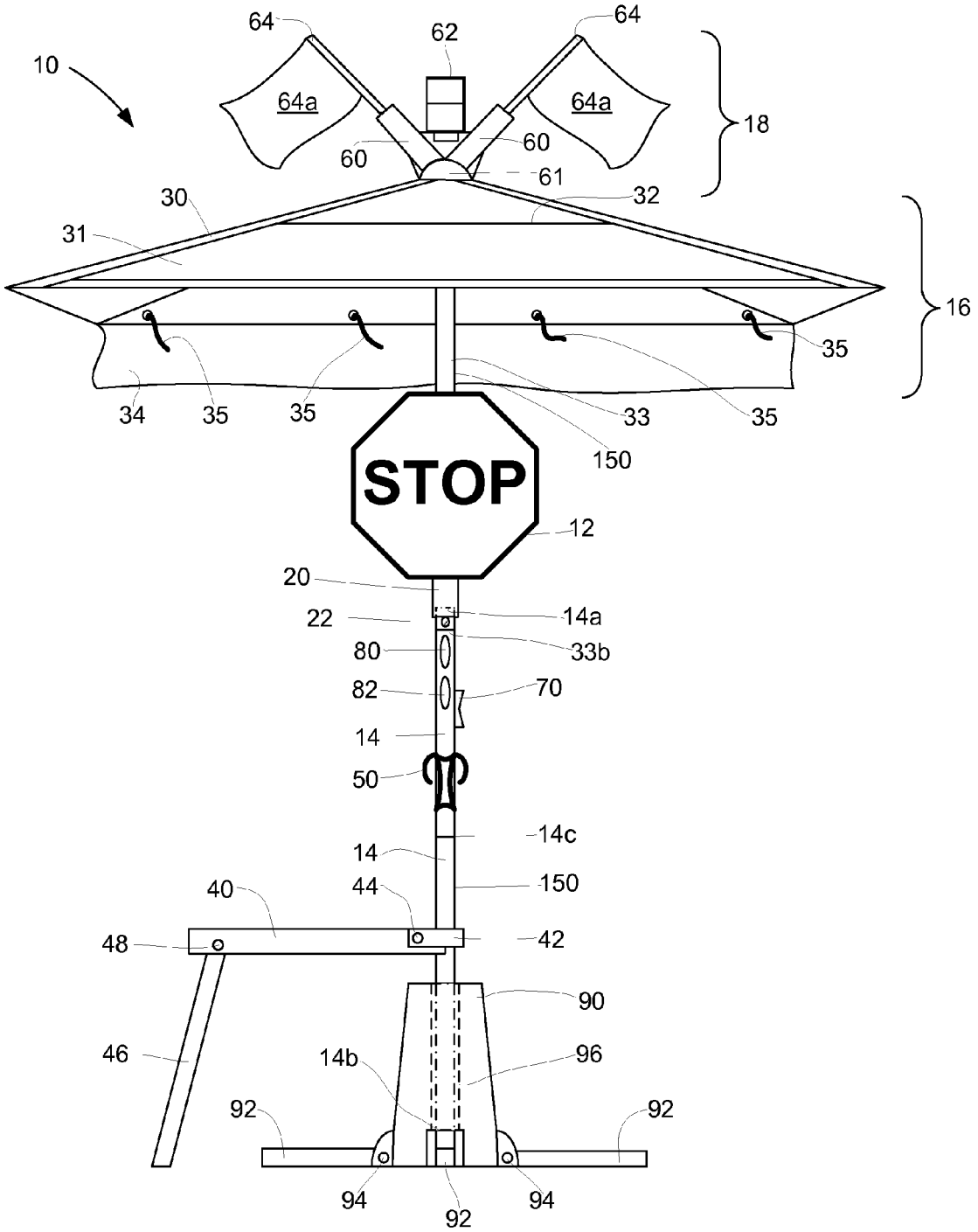
FIG. 1 is a side view of the safety sign system of the present invention with the umbrella canopy attached.

FIG. 1 illustrates the safety sign system 10 of the present invention. The safety sign system comprises one or more traffic or informational signs 12, an expandable base pole 14, a detachable umbrella canopy assembly 16 comprising a canopy 31 and canopy pole 33, and a safety finial assembly 18. Base pole 14 and canopy pole 31 are configured to attach together to form one substantially continuous center pole 150 where the first end or upper portion of center pole 150 is canopy pole 33 and the second end or lower portion of center pole 150 is base pole 14. The signs are removably attached to a removable sleeve 20 that surrounds a portion of a base pole 14 or a canopy pole 33 and rests upon a sign support 22. Sleeve 20 is illustrated in FIGS. 3-5 and 11-12. The signs 12 and sleeve 20 swivel about base pole 14 or canopy pole 33. The umbrella canopy assembly is attached to an upper end 14*a* of the base pole 14 and may include additional features including reflective tape 30, vents 32, drop-down flaps 34, reflective coating 36, and lights 37. The safety finial assembly 18 is removably attached to the top of the umbrella canopy assembly 16 and may include flag supports 60, removable flags 64, and a safety light 62. The safety sign system optionally further comprises a collapsible seat 40, a beverage holder 50, a satellite tracking device 80, a communication device 82, a base 90, and a control panel 70 for operating the safety light 62 and other features.

Figure 9:
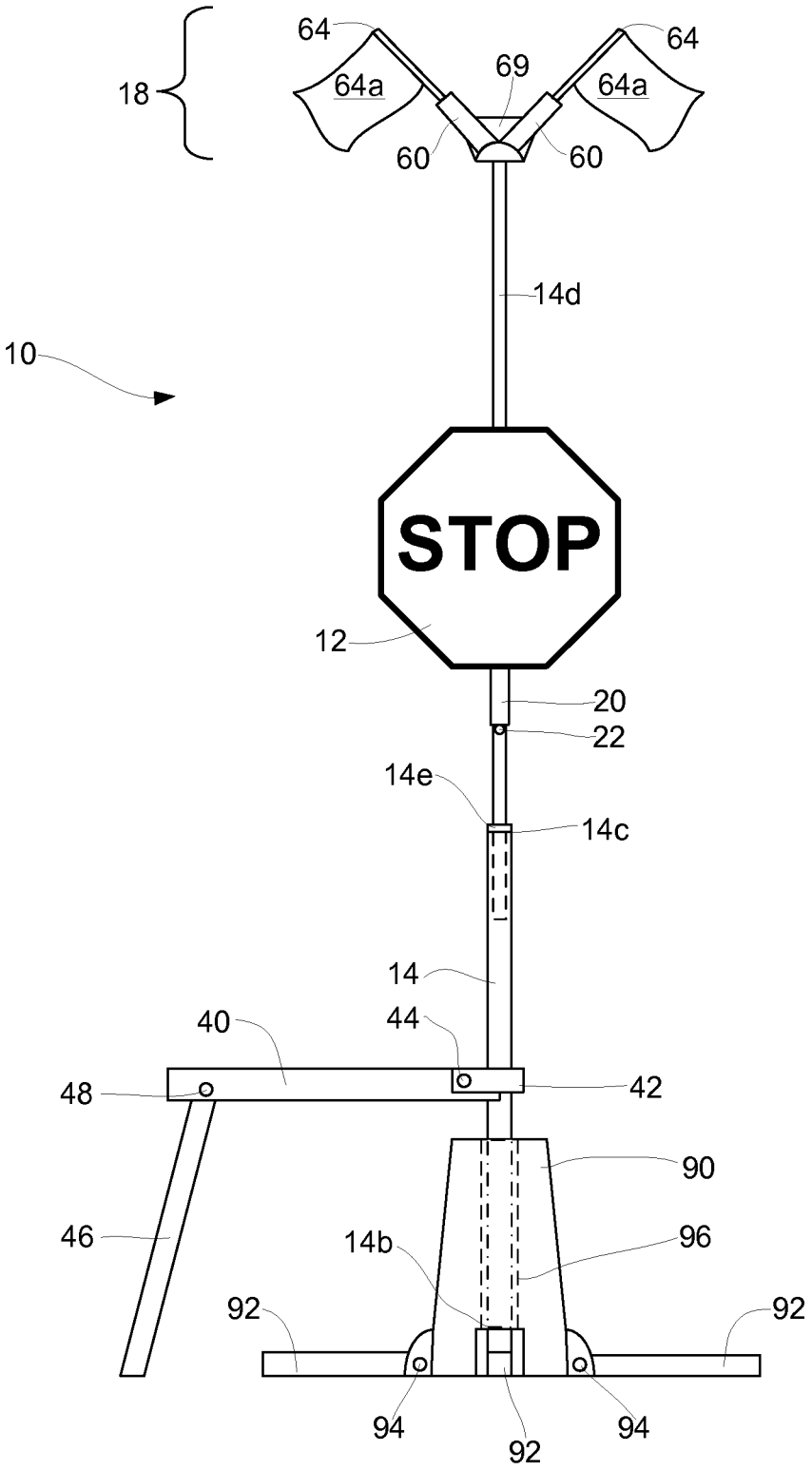
FIG. 9 is a side view of the safety sign system of the present invention with the umbrella canopy assembly detached.

Center pole 150 and base pole 14 are generally positioned at the center of the overall footprint of the safety sign system. Base pole 14 comprises first end 14*a* and second end 14*b* and can be one continuous member or several members attached at joints such as joint 14*c* as shown in FIG. 1. Preferably, base pole 14 defines an inner hollow channel through which one or more inner members 14*d* reciprocate. Inner member 14*d* is shown in FIG. 9 and can be used to further expand the overall length of base pole 14, to provide additional means of customizing safety sign system 10, to increase the overall length of base pole 14 and consequently center pole 150, and to increase the strength and rigidity of base pole 14. Inner members 14*d* can extend from base pole 14 at either the first end 14*a* or the second end 14*b*. Preferably, inner members 14*d* are hollow and optionally can allow another inner member (not shown) to reciprocate. Also preferably, base pole 14 and inner members 14*d* are preferably comprised of aluminum, steel, or polyvinyl chloride (PVC) materials, although any significantly rigid and strong material can be used. Inner members 14*d* and base pole 14 can be secured in various positions with a pressure or tension button that meets a hole in the outer pole such that when the button intersects the hole, the inner pole is locked into position. Similarly, if the base pole 14 is comprised of several sections joined at joints such as joint 14*c*, the sections preferably are secured to each other with cooperating threading or with pressure or tension buttons as described above. Each section may have a slightly smaller diameter to allow the sections for nesting and to accommodate the pressure or tension buttons. Alternatively, all of the sections may have consistent diameters and have one end with a smaller diameter segment where the pressure or tension buttons are located.

Figure 2:
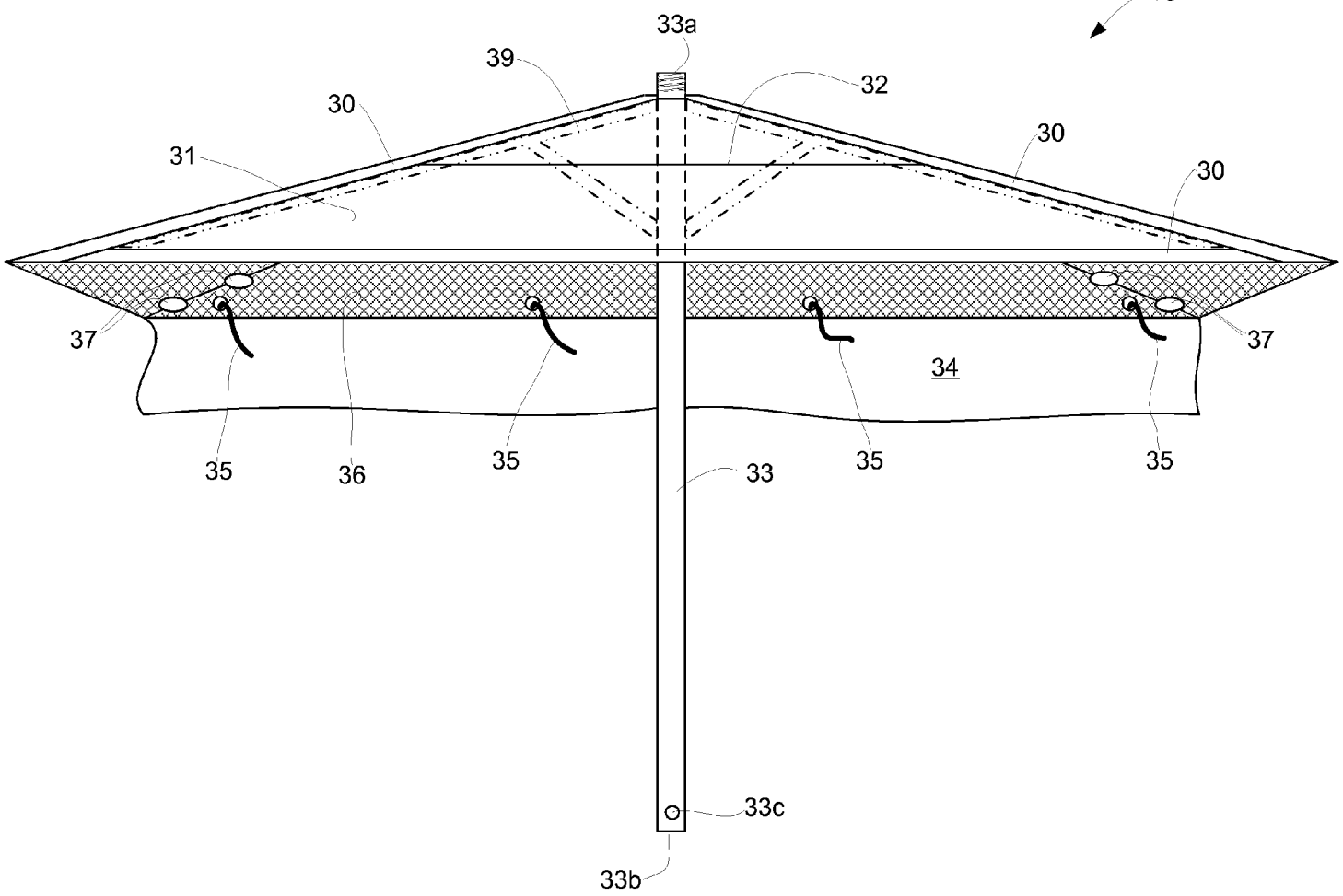
FIG. 2 is a side view of the umbrella canopy assembly of the present invention.

FIG. 2 illustrates the umbrella canopy assembly 16 of the present invention. As shown, canopy assembly 16 comprises a canopy pole 33 having a first end 33*a* and a second end 33*b*. The first end of canopy pole 33 is threaded to cooperate with finial assembly 18. The second end 33*b* of canopy pole 33 is configured to cooperate with the first end of base pole 14. Preferably, the second end 33*b* of canopy pole 33 defines one or more holes 33*c* through which a pressure button on base pole 14 can be inserted to lock base pole 14 and canopy pole 33 together or has one or more pressure buttons attached to it that can be inserted in holes defined by base pole 14 to lock base pole 14 and canopy pole 33 together and form center pole 150. Alternatively, the second end 33*b* of canopy pole 33 defines an inner threaded channel to receive the upper end of base pole 14, and the upper end of base pole 14 is cooperatively threaded. Alternatively, any method of attaching two poles together can be substituted as will be known to someone skilled in the art. Canopy pole 33 is preferably cylindrical and can be substantially solid, substantially hollow, or a combination thereof. Canopy pole 33 is preferably comprised of aluminum, steel, or PVC. Preferably canopy pole 33 is of a length approximately equal to or greater than the overall radius of the attached canopy 31 so that when canopy 31 is collapsed, canopy pole 33 remains accessible. Shorter or longer lengths are acceptable as well, however. When connected, base pole 14 and canopy pole 33 form one substantially continuous center pole. In an alternate embodiment of the present invention, canopy pole 33 and base pole 14 are integral. For example, one continuous center pole is substituted for the combination of the canopy pole 33 and base pole 14.

Attached to and around canopy pole 33 is canopy 31 as shown in FIGS. 1 and 2. Canopy 31 is attached to canopy pole 33 with a collapsible frame 39 as is common with many types of umbrellas including rain umbrellas, patio umbrellas, and large commercial umbrellas. Canopy 31 can be any traditional umbrella canopy shape, as is known in the art, or can be a custom shape depending on the environment in which it will be used. Preferably, canopy 31 is shaped like a pyramid with a square perimeter and is sized large enough to protect and provide shelter to a traffic controller located under canopy 31 from harmful ultraviolet rays, rain, or other inclement weather. Alternatively, canopy 31 can be flattened for added visibility from the sides or it could be round, rectangular, or any other two-dimensional or three-dimensional shape. Canopy 31 is preferably comprised of highly-visible water-repellant fabric. Other rigid or flexible materials suitable for providing protection from the sun or rain can be substituted, however, as is known in the art.

Canopy 31 can further comprise reflective tape 30 or other reflective materials attached to the canopy at various locations to further enhance its visibility as shown in the Figures. Canopy 31 can optionally further comprise one or more vents 32 defined in the canopy to stabilize the umbrella in slightly windy conditions, a reflective or non-reflective inner lining 36 attached to the underside of the canopy 31 as shown in the Figures to respectively provide increase or decrease light under the canopy, one or more lights 37 attached to the canopy to light an area or enhance visibility, and one or more flaps 34 to provide the traffic controller with further protection from environmental elements. Optional flaps 34 are preferably drop-down flaps as shown in the Figures that can be rolled up and secured with ties 35 against the canopy 31 when not in use. Alternatively, flaps can be removable and can be attached or secured with any type of fastener including, for example, buttons, carabiners, zip-ties, hook-and-loop fasteners, or snaps.

Figure 11:
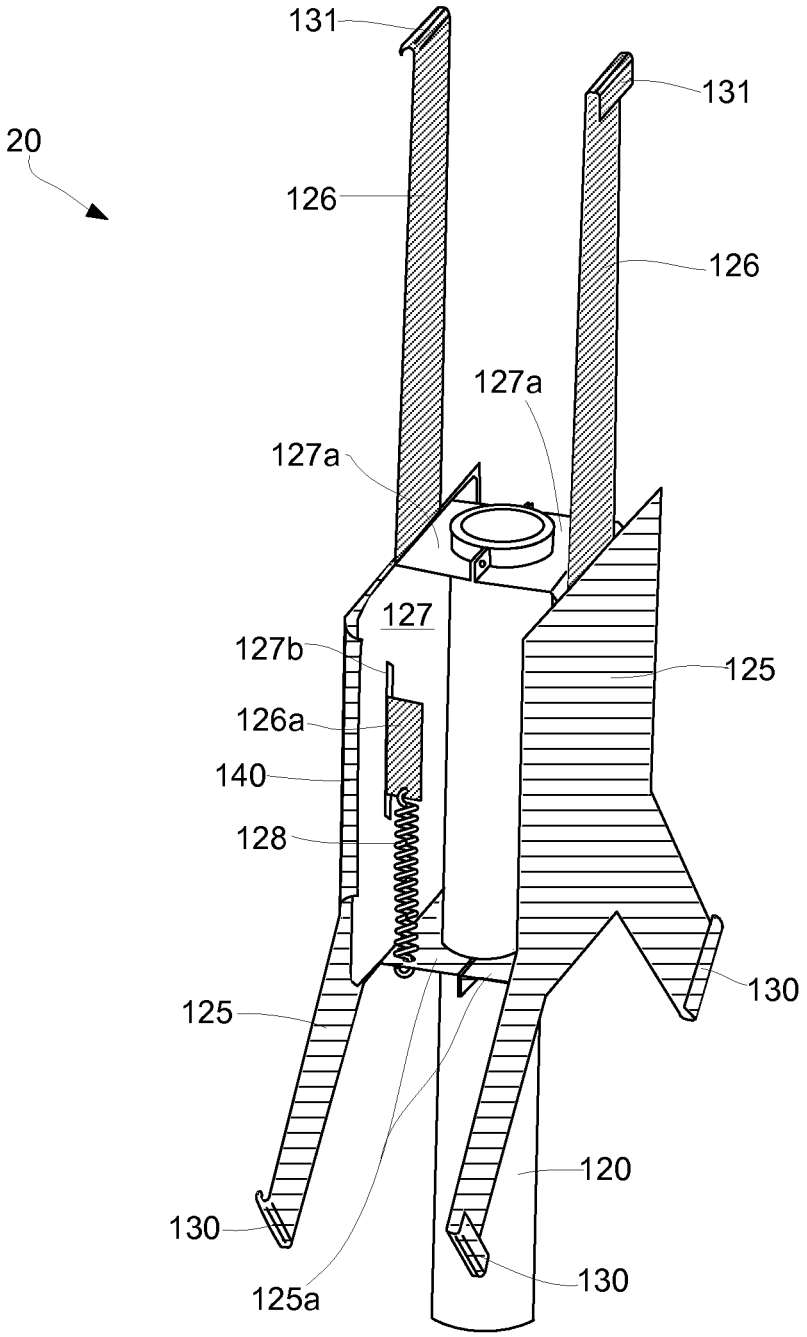
FIG. 11 is a perspective view of the preferred sign mount and sleeve of the present invention.
Figure 12:
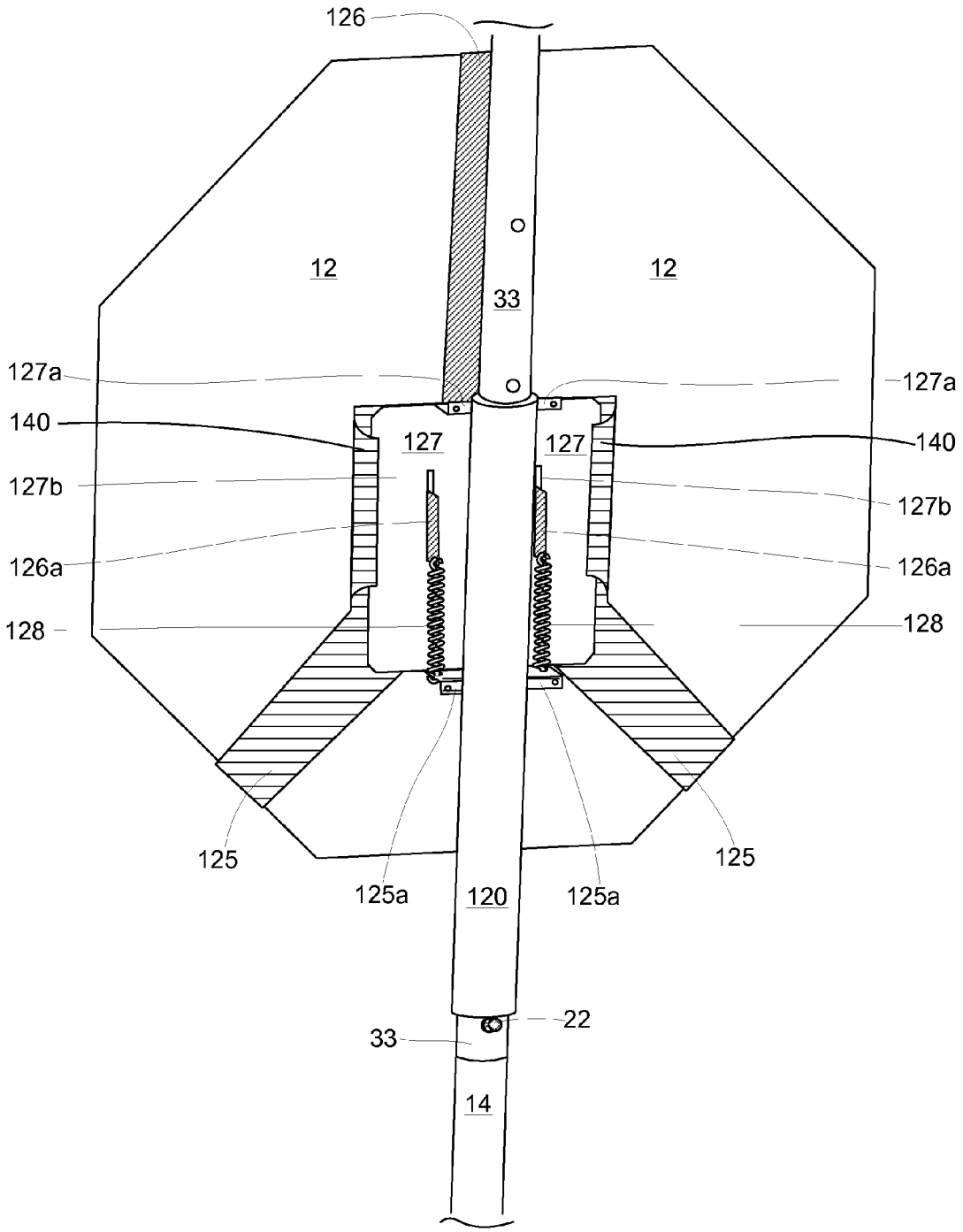
FIG. 12 is an alternative perspective view of the preferred sleeve, the expandable pole, and a support pin of the present invention.

FIGS. 11-12 illustrate the preferred embodiment of sleeve 20 and sleeve support 22. Sleeve 20 is configured to surround center pole 150 at either canopy assembly canopy pole 33 or base pole 14 without being fixed to canopy pole 33 or base pole 14 such that sleeve 20 can swivel about canopy pole 33 or base pole 14. Preferably, sleeve 20 comprises a tubular member 120 that can be slid onto base pole 14 at one of the pole ends and is easily removable should a traffic operator wish to use the safety sign system 10 without the signs 12 or sleeve 20. Tubular member 120 is preferably solid and continuous plastic. One or more sign mounts are secured to tubular member 120 with fasteners such as screws (not shown) or alternatively with adhesive or other fasteners. Alternatively, if two sign mounts are used, the two sign mounts can be tightly secured to each other thereby securing each sign mount to the pole with tension and friction. Two sign mounts are preferable to support two signs 12.

Each sign mount comprises a base plate 127, a lower plate 125, and an upper plate 126. Base plate 127 defines one or more support sections 127*a* and one or more slots 127*b*. One support section 127*a* and two slots 127*b* are preferred as sown in FIGS. 11 and 12. Upper plate 126 comprises one or more lips 131 and one or more protrusions 126*a*. One lip 131 and two protrusions 126*a* are preferred as shown in FIGS. 11 and 12. Protrusions 126*a* are configured to cooperate with slots 127*b* such that protrusions 126*a* can translate in slots 127*b*. Lower plate 125 comprises one or more lips 130 and one or more support sections 125*a*. Two lips 130 and one support section 125*a* are preferred as shown in FIGS. 11 and 12. Plates 125, 126, and 127 are preferably made of sheet metal and are held together with one or more springs 128 and with edge fasteners 140. Springs 128 are tension springs that connect at one end to upper plate protrusions 127*b* and at the other end to lower plate support section 125*a*. Edge fasteners 140 preferably are channels formed along the edges of lower plate 125 that are configured to cooperate with the edges of base plate 127, although any method of removably securing two plates together at or near their respective edges is acceptable as is known in the art. Protrusion 127*b* and lower plate support section 125*a* can each define holes through which to attach a hook, loop, or other fastener on the end of spring 128. Base plate support section 127*a* and lower plate support section 125*a* also can each define holes through which fasteners can be used to tightly secure two sign mounts together, as shown in the Figures. Alternatively, other methods of securing the plates together may be substituted as is known in the art.

For each sign mount, lips 130 and 131 are configured to wrap around the edge of sign 12 and secure it against upper plate 126 and lower plate 125 respectively. Plates 125, 126, and 127 can have any perimeter as long as they are configured to situate lips 130 and 131 at the perimeter of the sign to be supported. Additionally, while lips 130 and 131 are illustrated and described, other methods of attaching the perimeter of the sign 20 to the plates 125 and 126 are acceptable such as clips, hook and loop fasteners, ties, snaps, clamps, and adhesive.

Figure 3:
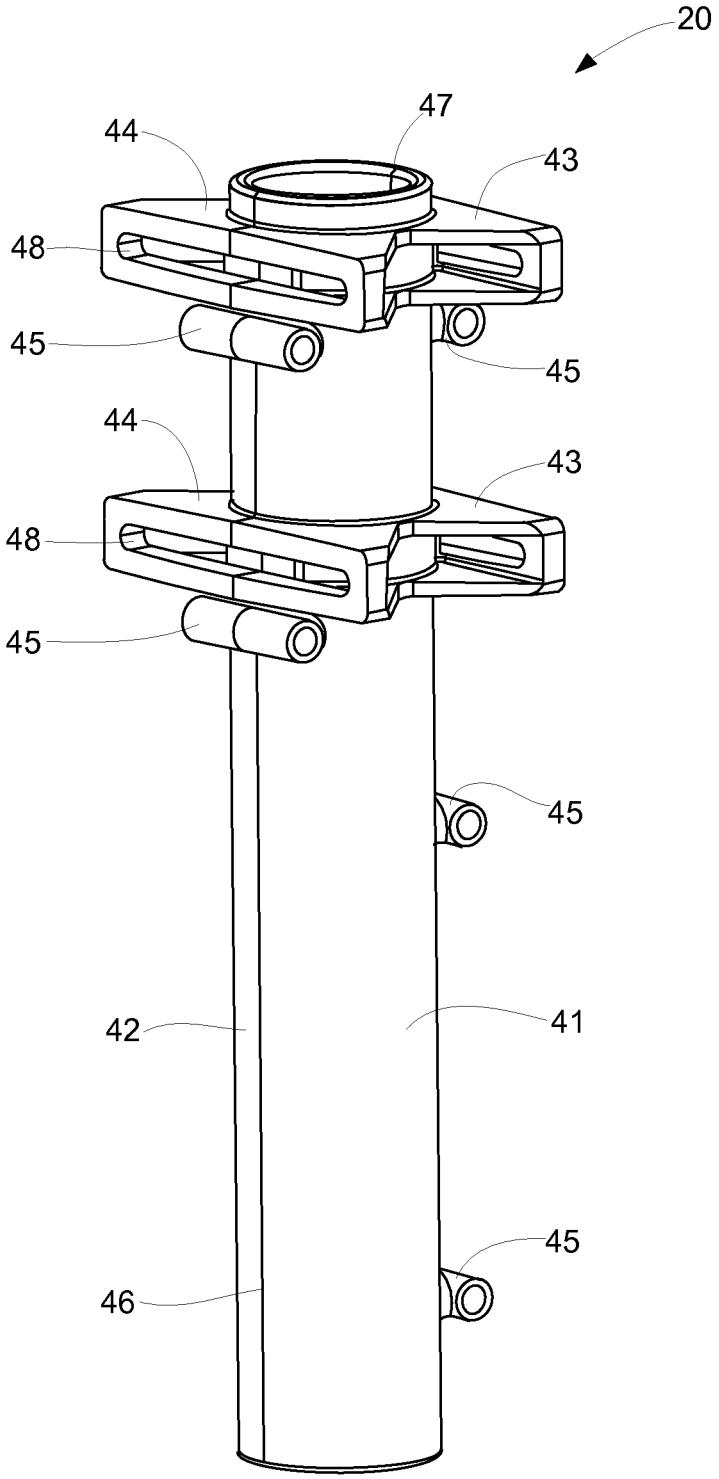
FIG. 3 is a perspective view of one embodiment of the sleeve of the present invention.
Figure 4:
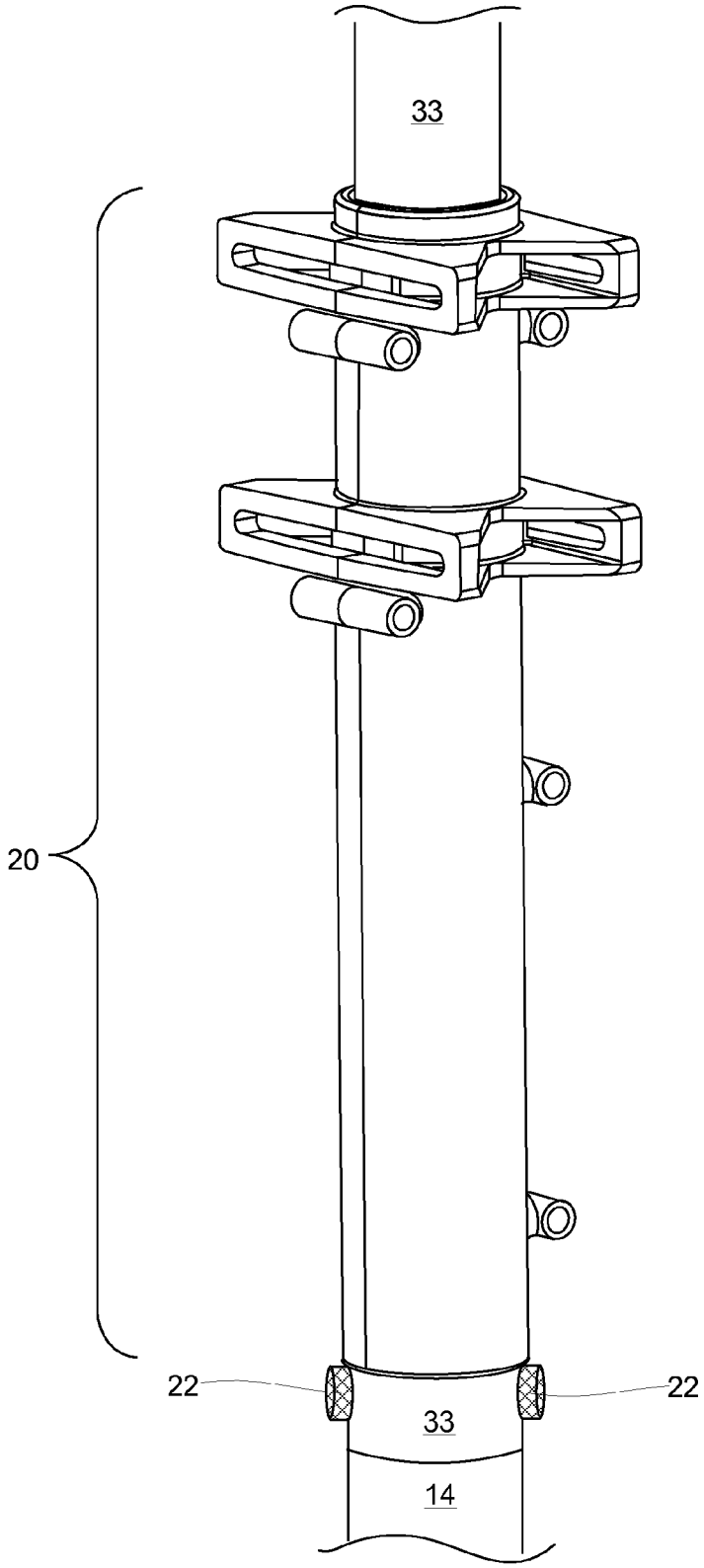
FIG. 4 is a perspective view of one embodiment of the sleeve, the expandable pole and a support pin of the present invention.
Figure 5:
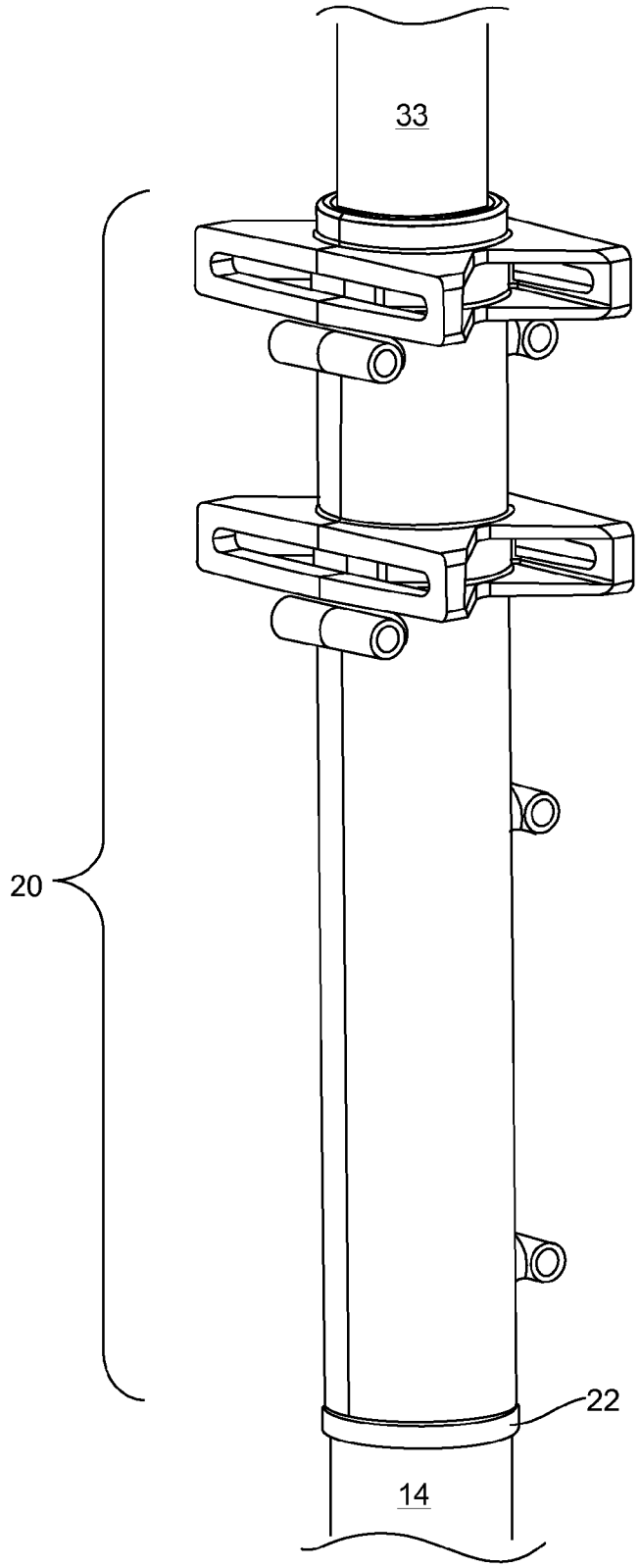
FIG. 5 is a perspective view of one embodiment of the sleeve, the expandable pole and an annular support flange of an alternative embodiment of the present invention.

FIGS. 3-5 illustrate an alternative embodiment of the sleeve 20 and sleeve support 22. The embodiment of sleeve 20 shown in FIG. 3 comprises a first semi-cylindrical member 41 and a second semi-cylindrical member 42 that are pivotally joined at joint 46 that runs lengthwise along one side of each of semi-cylindrical members 41 and 42 as shown. Semi-cylindrical members 41 and 42 are made of a solid piece of PVC or aluminum. To place the sleeve around center pole 150 at canopy pole 33 or base pole 14, the semi-cylindrical members 41 and 42 are separated from one another at joint 47, which is diametrically opposed to joint 46. They are then placed around canopy pole 33 or base pole 14 and closed at joint 47 to form a complete cylinder. Fasteners 45 secure the two semi-cylindrical members in the closed position. Sleeve 20 is preferably generally cylindrical in shape when it is in a closed position, although other shapes are acceptable as long as they allow sleeve 20 to swivel about canopy pole 33 or base pole 14.

Sleeve 20 further comprises one or more sign mounts where the sign mounts comprise one or more brackets 43 and 44 fixedly attached to or integrally formed with each of the semi-cylindrical members 41 and 42, respectively. Brackets 43 and 44 form a mounting surface for one or more signs 12 when the semi-cylindrical members 41 and 42 are in the closed position, as shown in the Figures. Sign 12 can be mounted to brackets 43 and 44 with hardware or with other methods such as hook-and-loop fasteners or adhesive. Preferably, sign 12 is mounted so that it can be easily removed. Also preferably, sign 12 is mounted with hardware such as screws that attach through holes (not shown) on sign 12 and through channels 48 formed by brackets 43 and 44.

When sleeve 20 is secured around center pole 150 at canopy pole 33 or base pole 14, it is positioned to rest on sleeve support 22 when base pole 14 is in an upright position. Base pole 14 is in an upright position when vertically aligned such that upper end 14*a* is positioned substantially directly above lower end 14*b*. When base pole 14 is in an upright position, canopy pole 33 and center pole 150 likewise are in upright positions, and center pole 150 is oriented with its first end up. Sleeve support 22 can be any type of support that prevents an object from sliding down due to gravitational force. FIGS. 4 and 12 illustrate a preferred embodiment of the sleeve support 22. As shown, sleeve support 22 comprises one or more pins that extends radially outward from canopy pole 33 or base pole 14. The pins can be the pressure or tension buttons already present on canopy pole 33 or base pole 14 or they can be dedicated support pins. Additionally, the pins can be two diametrically opposed pins, three or more evenly spaced pins, or one pin that extends across at least the diameter of sleeve 20. The pins can extend from the outer edge of canopy pole 33 or base pole 14 or they can extend from within canopy pole 33 or base pole 14 and through holes defined in canopy pole 33 or base pole 14. FIG. 5 illustrates an alternative embodiment of the present invention where sleeve support 22 comprises an annular flange that extends radially outward from canopy pole 33 or base pole 14. With either embodiment, sleeve support 22 can be fixedly attached to canopy pole 33 or base pole 14 with hardware or adhesive, or it can be integrally formed with canopy pole 33 or base pole 14. Preferably sleeve support 22 is comprised of the same material as canopy pole 33 or base pole 14, although it can be comprised of any material that can withstand the weight of sleeve 20 and one or more attached signs 12.

Sleeve 20 preferably is made of a solid piece of PVC or aluminum. Optionally, sleeve 20 can be comprised of a material that minimizes friction between sleeve 20 and canopy pole 33 or base pole 14 or either can be comprised of a material that increases friction between sleeve 20 and canopy pole 33 or base pole 14 depending on the degree of ease of swivel desired for the application. Similarly, sleeve 20 can include a lining (not shown) that minimizes or increases friction if desired. Materials can be selected and friction optimized so that a traffic controller can turn the signs with ease but a gust of wind does not cause the signs to swivel. In an additional embodiment of the present invention, sleeve 20 is attached to a motor and swivels in response to a traffic controller turning the motor on or off.

Signs 12 can be any traffic or informational sign. For example, two signs can be mounted on sleeve 20 where a first sign says STOP and a second sign says SLOW. Alternatively, a first sign may say TURN RIGHT and a second sign may say TURN LEFT. Preferably, signs 12 are standard signs used by traffic controllers or signs generally used in the construction industry, for event parking, and in the traffic control industries.

Figure 6:
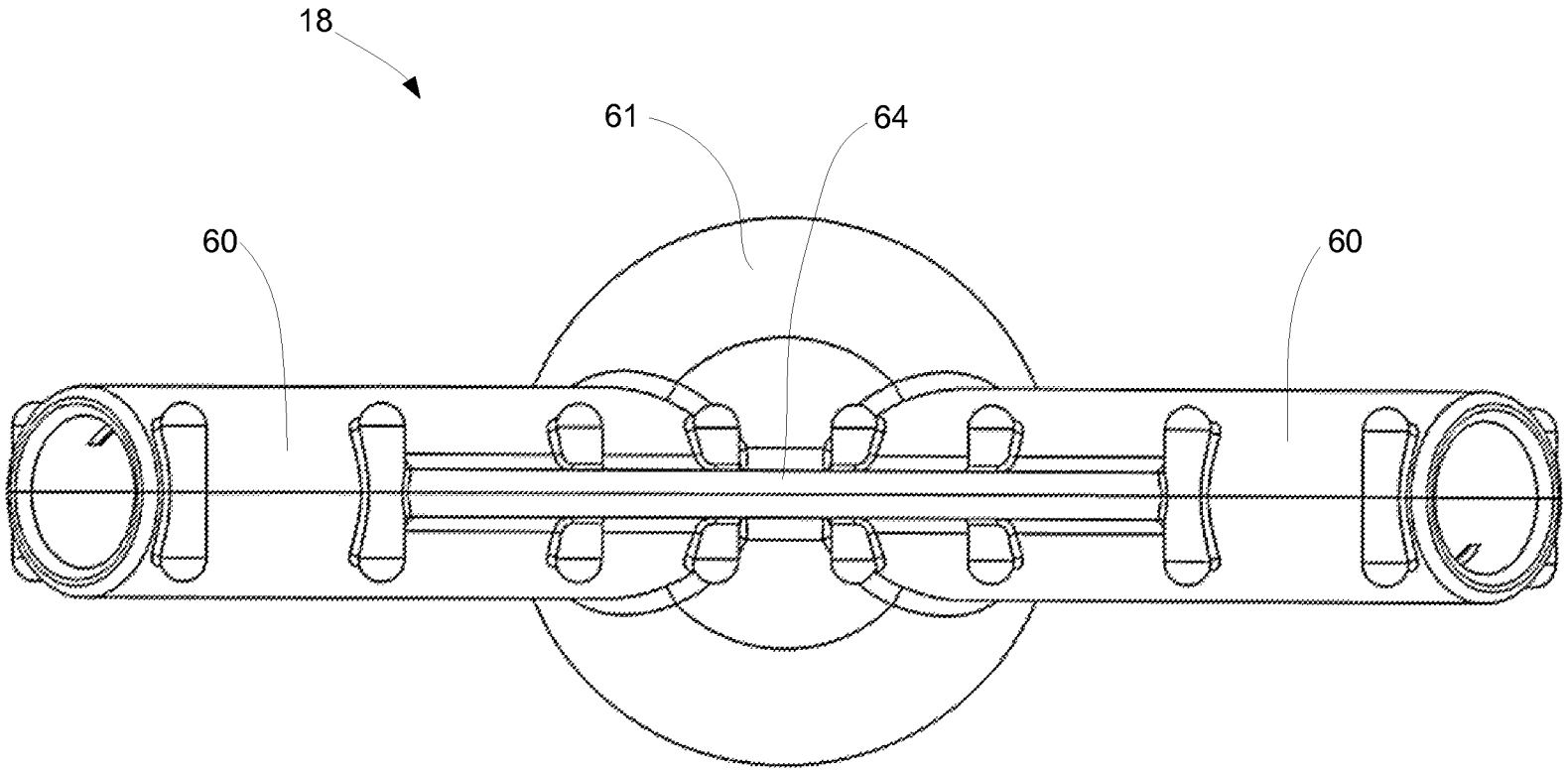
FIG. 6 is a top view of the finial assembly of the present invention.
Figure 7:
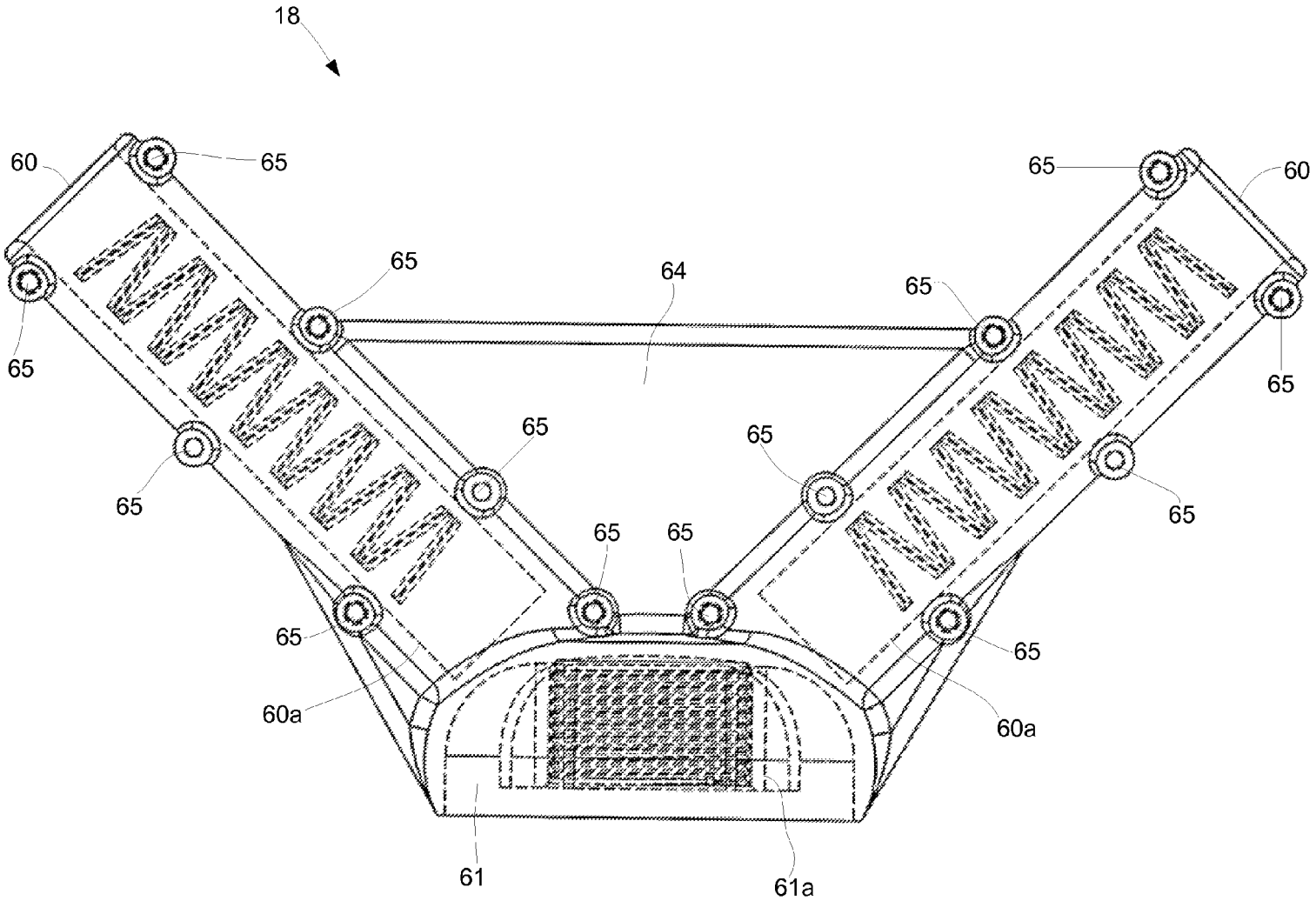
FIG. 7 is a side view of the finial of the safety sign system of the present invention.
Figure 8:
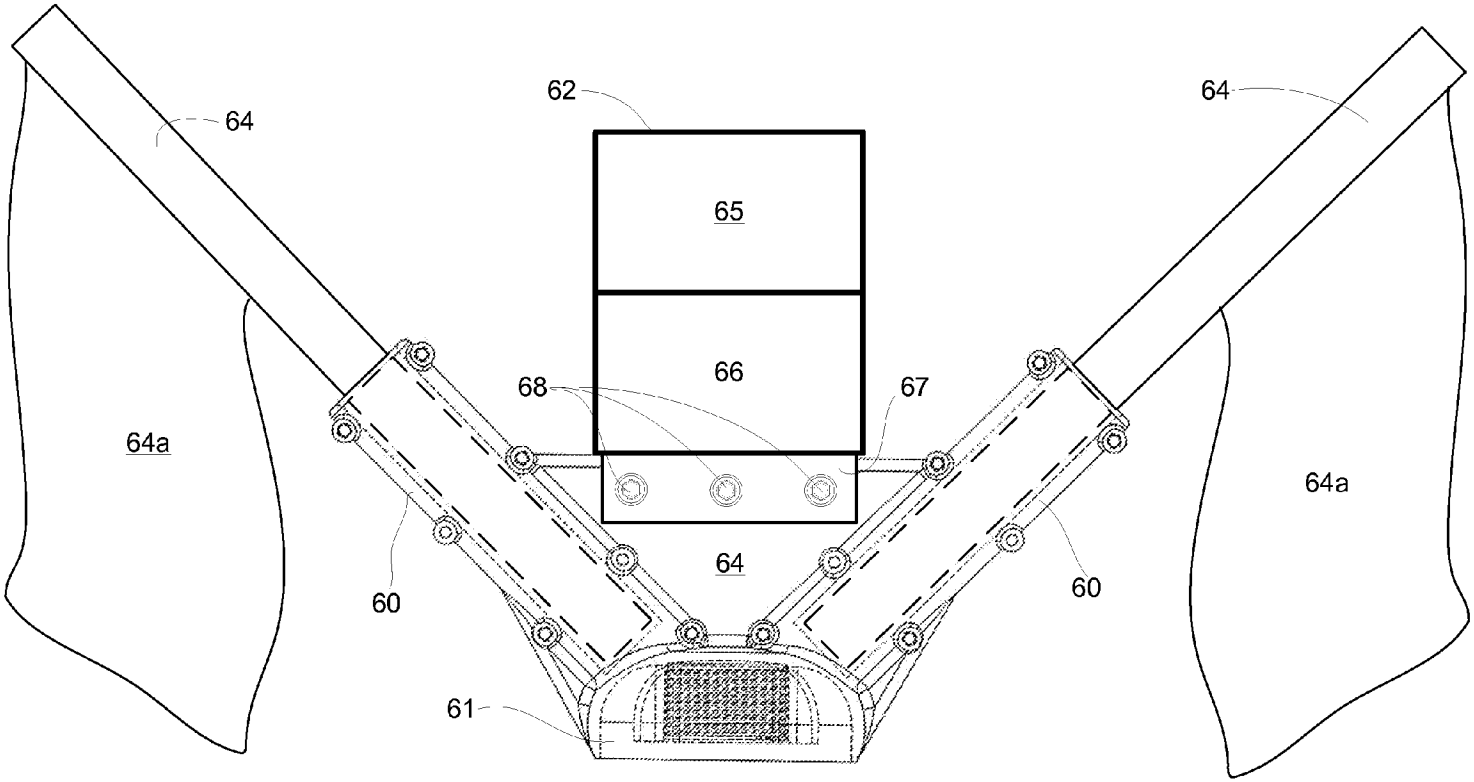
FIG. 8 is a side view of an alternative embodiment of the finial assembly of the present invention.

FIGS. 6-7 illustrate one embodiment of finial assembly 18. Finial assembly 18 attaches to the first end of canopy pole 33 of umbrella canopy assembly 16 or to the top of canopy assembly 16. Finial assembly comprises a cap 61 and one or more flag supports 60 fixedly attached to or integrally formed with cap 61. Finial assembly 18 if preferably a solid molded part or comprised of two injection molded plastic components that are fixedly attached together with fasteners 65 as shown in FIG. 7. Cap 61 preferably defines a threaded channel 61*a* that is configured to cooperate with threads on the outer surface of canopy pole 33 or to the top of canopy assembly 16. Alternatively, cap 61 can be removably attached to canopy pole 33 or to the top of canopy assembly 16 with hardware or adhesive. Flag supports 60 also preferably define a threaded channel 60*a* that is configured to cooperate with threads on the outer surface of flags 64 as shown in FIG. 8. Flags 64 can be any type of construction flag used for increasing visibility and preferably include a flexible material 64*a* that is highly visible and can substantially withstand environmental elements such as wind, rain, snow, hail, and ultraviolet rays. Flags 64 alternatively can be removably attached to flag supports 60 with other means such as hardware or adhesive. In another alternative, components of Flags 64 can be integrally formed with flag support 60.

FIG. 8 illustrates an alternative and preferred embodiment of finial assembly 18 that includes a finial support 69 and detachable safety light 62. Detachable safety light 62 can be secured to finial support 69 with bracket 67 and fasteners 68. Bracket 67 also supports one or more safety lights 66 and 65 and preferably supports at least two lights of different colors. Lights 65 and 66 can be any type of safety light that is commonly used in construction, is used to increase visibility, or is used to express traffic directions or signals. For example, Light 65 may be a red strobe light, and light 66 may be a green strobe light. The lights can be arranged vertically as shown or in another manner such as side-by-side. Lights may be configured to be steadily lit when powered on or they may be configured to pulse, blink, or flash. Lights 65 and 66 are preferably powered by a solar-powered battery (not shown) that is attached to the safety light 62. Alternatively, lights may be powered by a removable and rechargeable battery or other means as is known in the art.

Preferably, safety light 62 receives signals from a control panel 70 either through direct electrical communication with control panel 70 or through wireless communication between a transmitter on control panel 70 and a receiver on safety light 62. Control panel 70 can solely operate safety light 62 or it can be configured to operate additional features of safety sign system 10 as well. Additionally, control panel 70 can simply be a power switch that turns safety light 62 on or off, it can be a switch that activates power and allows the traffic controller to select which light 65 or 66 to activate, or it can include features that allow the traffic controller to select between different features of lights 65 or 66 such as whether the lights are steadily lit or flashing. Control panel 70 can further include features that allow the traffic controller or another person to enter various parameters or programming instructions. Control panel 70 is preferably attached to center pole 150 and more preferably attached to base pole 14 below sleeve support 22 and within easy reach of the traffic controller.

Additional features of the safety sign system 10 include a collapsible seat 40 for the traffic controller and a removable beverage holder 50. Collapsible seat 40 preferably is pivotally attached with a hinge 44 to a seat attachment bracket 42. Seat attachment bracket 42 is removably or fixedly secured to base pole 14 with hardware, adhesive, or other attachment means. Seat 40 preferably also includes one or more leg supports 46 that are pivotally attached to seat 40 with one or more hinges 48. Legs 46 are configured such that when in use, they support seat 40 and the weight of the traffic controller. Seat 40 and legs 46 are comprised of any material strong enough and sufficiently rigid to support the weight of a traffic controller.

Beverage holder 50 can be any type of removable beverage holder that can be secured to a pole such as removable beverage holders designed to be attached to a bicycle frame. Beverage holder 50 is preferably attached with hardware to canopy pole 33 or base pole 14 and is preferably located below control panel 70 and within easy reach of the traffic controller as shown in FIG. 1.

Safety sign system 10 optionally can further include a satellite tracking 80, a communication device 82, or both. Both devices can be attached to canopy pole or base pole 14, to sleeve 20, or can be included in control panel 70. The satellite tracking device 80 can be any type of satellite tracking device known in the art. Satellite tracking device 80 is useful for letting the general public remotely track current traffic restrictions so they can plan accordingly or select an alternate route. Communication device 82 can be any type of communication device. Preferably communication device 82 allows for communication between two or more traffic controllers located at the same construction area.

Safety sign system 10 preferably includes or is configured to cooperate with a base 90. Preferably, base 90 defines a channel 96 for receiving base pole 14. Base 90 also preferably includes one or more additional supports 92 to enhance the stability of base 90. Supports 92 can be rigidly attached or integral with base 90. Alternatively, supports 92 can be pivotally attached with hinges 94 as shown in FIG. 1. Base 90 can be any type of sign or umbrella base as is known in the art. Base 90 should be heavy enough to resist the force created by wind against the sign 12 or umbrella canopy assembly 16. Preferably base 90 further includes features that secure base pole 14 in channel 96 such as threading, brackets, adjustment screws, thumb screws, or other hardware.

Figure 10:
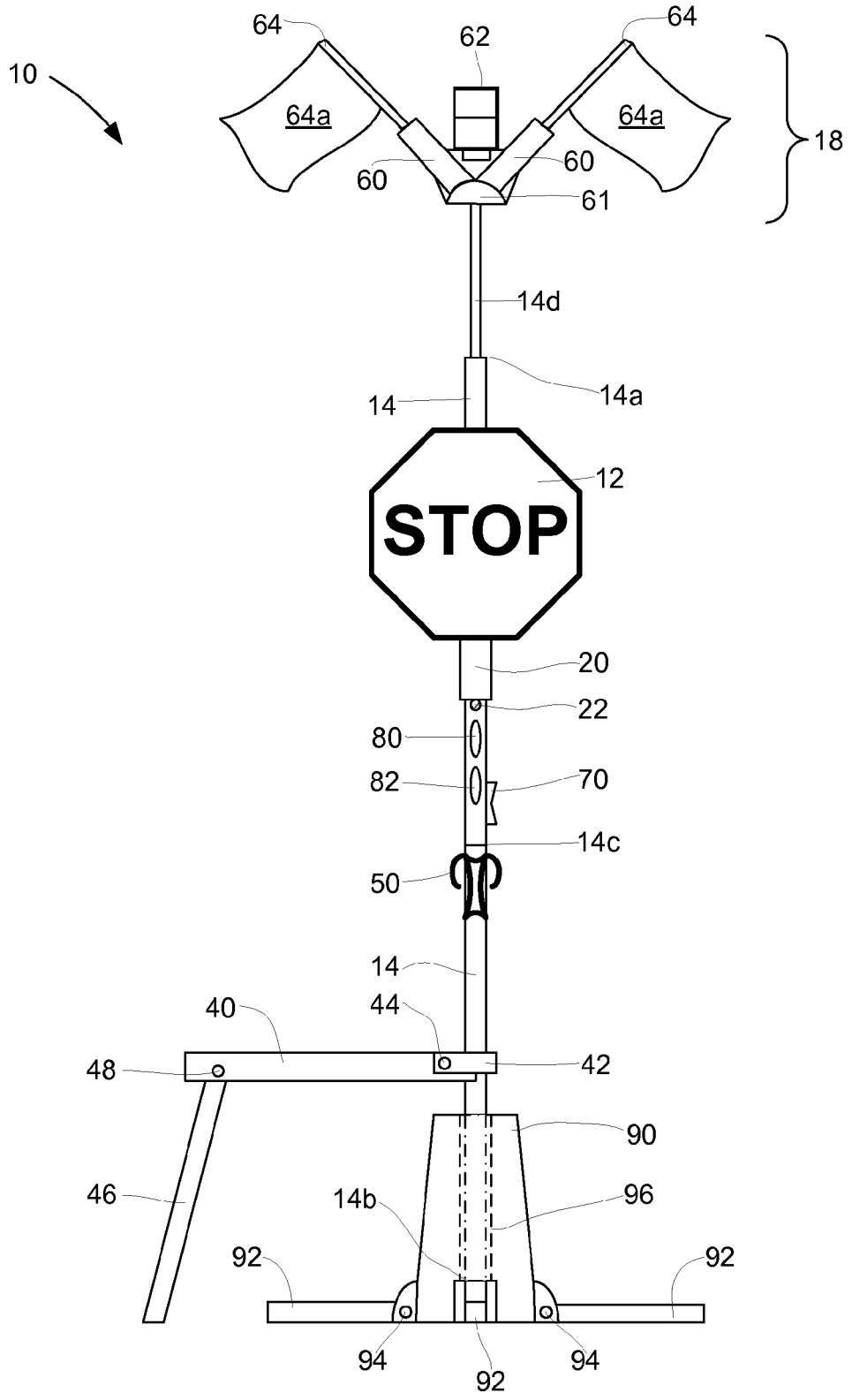
FIG. 10 is a side view of an alternate embodiment of the safety sign system of the present invention with the umbrella canopy assembly detached.

FIGS. 9 and 10 illustrate alternative embodiments of the safety sign system as configured without the umbrella canopy assembly 16. Occasionally, environmental conditions may cause the traffic controller to prefer the umbrella canopy assembly 16 be removed such as on a cloudy day with gusting winds. When this happens, umbrella canopy assembly 16 including canopy pole 33 can be separated from base pole 14. Finial assembly also can be removed from canopy assembly 16 and attached directly to base pole 14 or one of expandable pole inner member 14*ds*. Additional sections of base pole 14 can be removed as well if desired, and sleeve 20 alternatively can be rotatably positioned on one of inner members 14*d* as shown in FIG. 9. One of inner members 14*d* accordingly preferably includes a sleeve support 22.

To use the safety sign system 10, a traffic controller considers the current conditions in the environment and chooses whether to use the canopy assembly 16, finial assembly 18, or both and then chooses whether to use any additional features. For example, in rainy or sunny conditions, the safety sign system 10 is preferably used with both the canopy assembly 16 and alternate finial assembly 18 shown in FIG. 8. The drop-down flaps 34 can be lowered to further protect the traffic controller from the sun or rain. Flags 64 are secured in the flag supports 60, and preferably the safety light 62 is operational. Two traffic signs 12 are preferably attached to the sign sleeve 20 so that oncoming traffic can either read the first sign or the second sign. The traffic controller can swivel either the sleeve 20 or the signs 12 to display either the first sign or the second sign to the oncoming traffic. When either the sleeve 20 or the signs 12 are pushed by the traffic controller, both rotate. Additionally, the traffic controller can optionally control the safety light 62 to further communicate the desired traffic signal. If the weather becomes windy and the canopy no longer is desired, the canopy assembly 16 can be removed, and the base pole 14 can be expanded to support the sleeve 20 and signs 22. If desired, the finial assembly 18 also can be detached from the canopy assembly 16 and attached directly to the base pole 14 or pole inner member 14*d*. Also optionally, the sleeve 20 and signs 12 can be removed in favor of handheld signs, and the safety sign system can be used with just the canopy assembly and finial assembly.

While there has been illustrated and described what is at present considered to be the preferred embodiment of the present invention, it will be understood by those skilled in the art that various changes and modifications may be made and equivalents may be substituted for elements thereof without departing from the true scope of the invention disclosed, but that the invention will include all embodiments falling within the scope of the claims.

I claim:

1. A safety sign system comprising:

a. a center pole having a first end and a second end;

b. a removable umbrella canopy assembly comprising the first end of center pole and attached to the second end of center pole; and c. a finial assembly removably attached to the umbrella canopy assembly comprising:

i. a cap configured to removably secure the finial assembly to the umbrella canopy assembly; and ii. one or more flag supports attached to the cap.

2. The safety sign system of claim 1 wherein the finial assembly further comprises:

a. a finial support fixedly attached to the cap; and b. a safety light removably attached to the finial support.

3. The safety sign system of claim 1 further comprising:

a. a sleeve support attached to the center pole; and b. a sleeve surrounding the center pole and configured to swivel about the pole and to sit on the sleeve support due to gravitational force when the pole is oriented with its first end up.

4. The safety sign system of claim 3 further comprising one or more signs removably attached to the sleeve.

5. A safety sign system comprising:

a. a center pole having a first end and a second end;

b. a removable umbrella canopy assembly comprising the first end of center pole and attached to the second end of center pole;

c. a sleeve support attached to the center pole;

d. a sleeve surrounding the center pole and configured to swivel about the center pole and to sit on the sleeve support due to gravitational force when the center pole is oriented with its first end up;

e. a finial removably attached to the umbrella canopy assembly;

f. a cap configured to removably secure the finial assembly to the umbrella canopy assembly; and g. one or more flag supports attached to the cap.

6. The safety sign system of claim 5 wherein the finial assembly further comprises:

a. a finial support fixedly attached to the cap; and b. a safety light removably attached to the finial support.

7. The safety sign system of claim 6 further comprising a control panel attached to the pole wherein the control panel communicates with at least the safety light of the finial assembly.

8. The safety sign system of claim 7 wherein the control panel comprises a transmitter, wherein in the safety light comprises a receiver, and wherein the control panel and safety light communicate wirelessly.

9. The safety sign system of claim 6 wherein the safety light comprises two or more lights of different colors.

10. A safety sign system comprising:

a. a center pole having a first end and a second end and a satellite tracking device attached to the center pole;

b. a removable umbrella canopy assembly comprising the first end of center pole and attached to the second end of center pole;

c. a sleeve support attached to the center pole; and d. a sleeve surrounding the center pole and configured to swivel about the center pole and to sit on the sleeve support due to gravitational force when the center pole is oriented with its first end up.

11. A safety sign system comprising:

a. a base pole having a first end and a second end;

b. an umbrella canopy assembly removably attached to the first end of the base pole, wherein the umbrella canopy assembly comprises:

i. a canopy pole having a first end and a second end and wherein the second end of the canopy pole is configured to attach the umbrella canopy assembly to the first end of the base pole;

ii. a frame surrounding and fixedly attached to the canopy pole; and iii. a canopy removably attached to the frame;

c. a sleeve support attached to the base pole or canopy pole;

d. a sleeve surrounding the base pole or canopy pole and configured to swivel about the base or canopy pole and to sit on the sleeve support due to gravitational force when the base pole is oriented with its first end up;

e. one or more signs removably attached to the sleeve; and f. a finial assembly removably attached to the umbrella canopy assembly, wherein the finial assembly comprises:

i. a cap configured to removably secure the finial assembly to the first end of the canopy pole;

ii. one or more flag supports attached to the cap;

iii. a finial support fixedly attached to the cap; and iv. a safety light removably attached to the finial support.

* * * * *